US007666121B2

(12) United States Patent
Zhou

(10) Patent No.: US 7,666,121 B2
(45) Date of Patent: Feb. 23, 2010

(54) SURFING EXERCISER

(75) Inventor: Yuzhi Zhou, Fujian (CN)

(73) Assignee: Xiamen Zhoulong Sporting Goods Co., Ltd., Fujian (CN)

( * ) Notice: Subject to any disclaimer, the term of this patent is extended or adjusted under 35 U.S.C. 154(b) by 0 days.

(21) Appl. No.: 12/478,890

(22) Filed: Jun. 5, 2009

(65) Prior Publication Data

US 2009/0325767 A1 Dec. 31, 2009

(30) Foreign Application Priority Data

Jun. 25, 2008 (CN) ..... 2008 2 0102856 U

(51) Int. Cl.
*A63B 22/00* (2006.01)

(52) U.S. Cl. ..... 482/51; 482/146

(58) Field of Classification Search ..... 482/34, 482/51, 70, 71, 79, 80, 121, 122, 123, 126, 482/127, 142, 146, 147, 148, 908; 434/247, 434/250, 253, 258; 472/95, 96, 97; 462/36
See application file for complete search history.

(56) References Cited

U.S. PATENT DOCUMENTS 3,912,260 A * 10/1975 Rice ..... 482/4
4,749,180 A * 6/1988 Boomer ..... 482/51
4,850,588 A * 7/1989 Desjardins et al. ..... 482/51
7,374,522 B2 * 5/2008 Arnold ..... 482/146
7,465,262 B2 * 12/2008 Ho ..... 482/146

* cited by examiner

*Primary Examiner*—Loan H Thanh
*Assistant Examiner*—Tam Nguyen
(74) *Attorney, Agent, or Firm*—Banger Shia

(57) ABSTRACT

A surfing exerciser includes a seat, a seat frame, a chassis, a swing device, and a torsion spring. The seat is secured on the seat frame. The swing device includes an upper freewheel, a lower freewheel, a Z-shaped swivel shaft, a small pulley shaft, and a belt. The Z-shaped swivel shaft includes a lower swivel shaft, an upper swivel shaft, and a connecting board. The lower swivel shaft is fixed to a lower surface of the connecting board. The upper swivel shaft is fixed to an upper surface of the connecting board. The axis of the lower swivel shaft obliquely intersects with the axis of the upper swivel shaft. By the rotation inertia of the upper freewheel and the lower freewheel, the seat of the present invention is driven to move up and down as well as left and right for providing surfing or horse riding simulation.

4 Claims, 3 Drawing Sheets

SURFING EXERCISER

BACKGROUND OF THE INVENTION

1. Field of the Invention

The present invention relates to a gymnastic apparatus, and more particularly to a surfing exerciser.

2. Description of the Prior Art

There are many gymnastic apparatuses on the market, such as barbells and dumbbells for exercising limbs. For the demand of waist twirling exercise, there are different exercisers for surfing or horse riding. A conventional surfing exerciser or horse riding exerciser uses an electric machinery as the power source, which is complicated and heavy in structure, needs electric power, and is inconvenient in use.

SUMMARY OF THE INVENTION

The primary objective of the present invention is to provide a surfing exerciser which is simple in structure and convenient in use.

According to the present invention, there is provided a surfing exerciser, comprising a seat, a seat frame, a chassis, a swing device, and a torsion spring; the seat being secured on the seat frame, the swing device comprising an upper flywheel, a lower flywheel, a Z-shaped swivel shaft, a small pulley shaft, and a belt; the Z-shaped swivel shaft comprising a lower swivel shaft, an upper swivel shaft, and a connecting board, the lower swivel shaft being fixed to a lower surface of the connecting board, the upper swivel shaft being fixed to an upper surface of the connecting board, the axis of the lower swivel shaft obliquely intersecting with the axis of the upper swivel shaft, the upper flywheel being disposed above the chassis and rotatably fitted on the chassis through the lower swivel shaft of the Z-shaped swivel shaft; a first end of the seat frame being rotatably fitted on the upper swivel shaft of the Z-shaped swivel shaft through a transition rack, a second end of the seat frame being articulated to the chassis through a rocker; the small pulley shaft having a wheel driving portion located above the chassis and an axle portion passing through the chassis; the lower flywheel having a central hole for insertion of the axle portion of the small pulley shaft, the belt being disposed between the upper flywheel and the wheel driving portion of the small pulley shaft; the torsion spring being coupled to a front portion of the chassis and holding against the rocker for the seat at a high position constantly when in a static state.

Preferably, the front portion of the chassis is inserted with a rocker shaft, a lower end of the rocker and the torsion spring being inserted on the rocker shaft, the torsion spring having a first end secured to a front end of the chassis and a second end holding against the rocker for the rocker to swing upward.

Preferably, the surfing exerciser further comprises a belt tension adjusting mechanism, the belt tension adjusting mechanism comprising a press block, a swing rod, a pull rod, and a baffle plate; the press block being located at an outer side of the belt and holding against the belt; the swing rod having a first end connected to a lower end of the press block and a second end inserted on a pin fixed on the chassis; the pull rod having a first end connected to the press block and a second end passing through the baffle plate and screwed with a nut for adjusting the length of the pull rod by rotating the nut.

Preferably, the surfing exerciser further comprises a handle rod, the handle rod having a lower end fixed to a front end of the chassis.

The present invention has the following advantages:

1. The upper and lower flywheels have a specified weight. By the rotation inertia of the upper flywheel and the lower flywheel, the seat of the present invention is driven to move up and down as well as left and right for providing surfing or horse riding simulation.

2. The present invention uses the inertia of flywheel to drive instead of an electric machinery. Without the demand of power, the present invention is convenient in use. The main structure of the present invention comprises the upper flywheel and the lower flywheel, which is simple in structure.

3. The present invention adopts the torsion spring as the power source of the restoring mechanism. The torsion spring has better elasticity and the torsion spring's life is long. In addition, the torsion spring is mounted on a swivel shaft at the lower end of the rocker so that the present invention is compact and beautiful.

Embodiments of the present invention will now be described, by way of example only, with reference to the accompanying drawings.

DETAILED DESCRIPTION OF THE PREFERRED EMBODIMENTS

Figure 1:
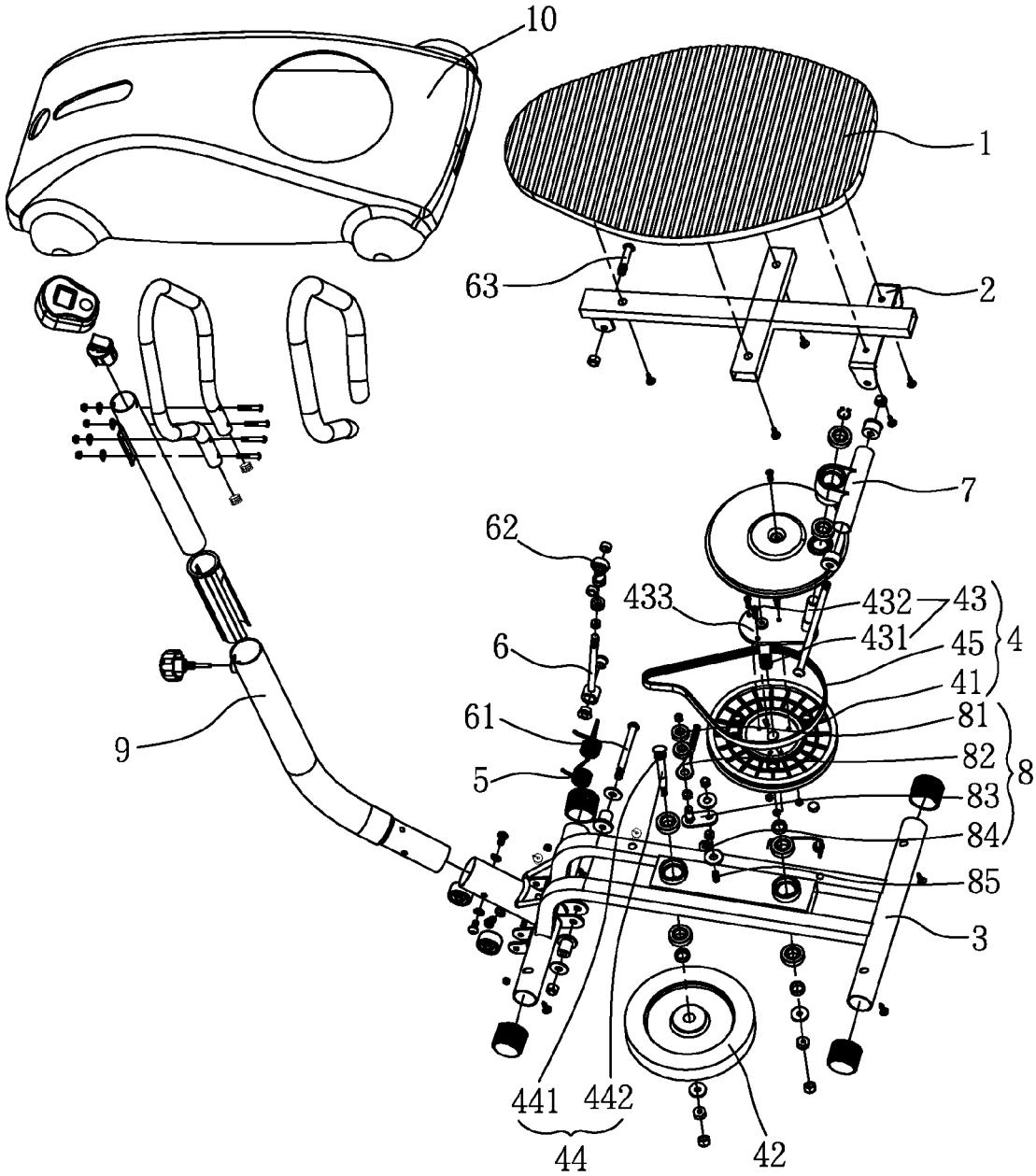
FIG. 1 is an exploded view of a first preferred embodiment of the present invention.
Figure 2:
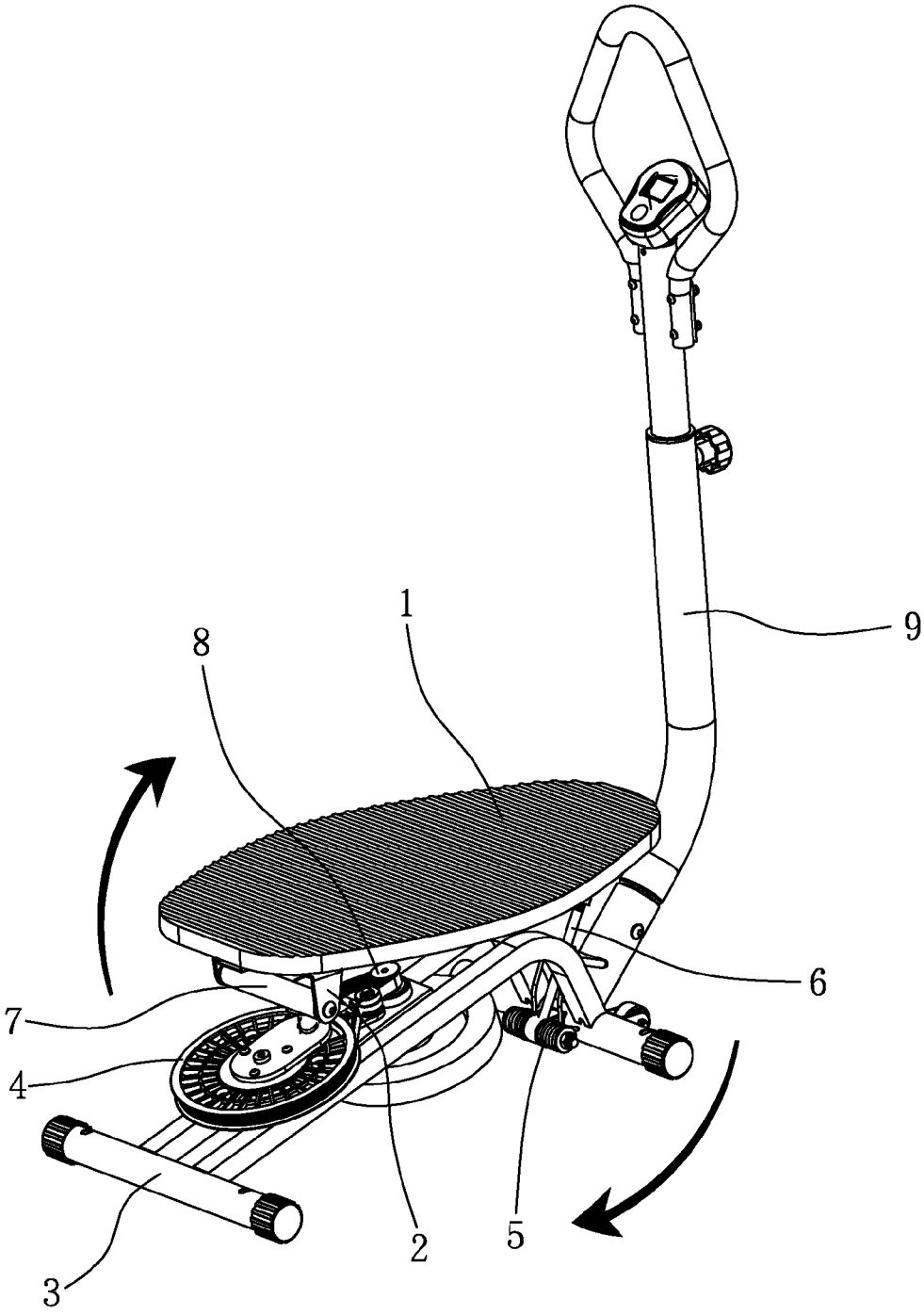
FIG. 2 is a perspective view of the first preferred embodiment of the present invention.
Figure 3:
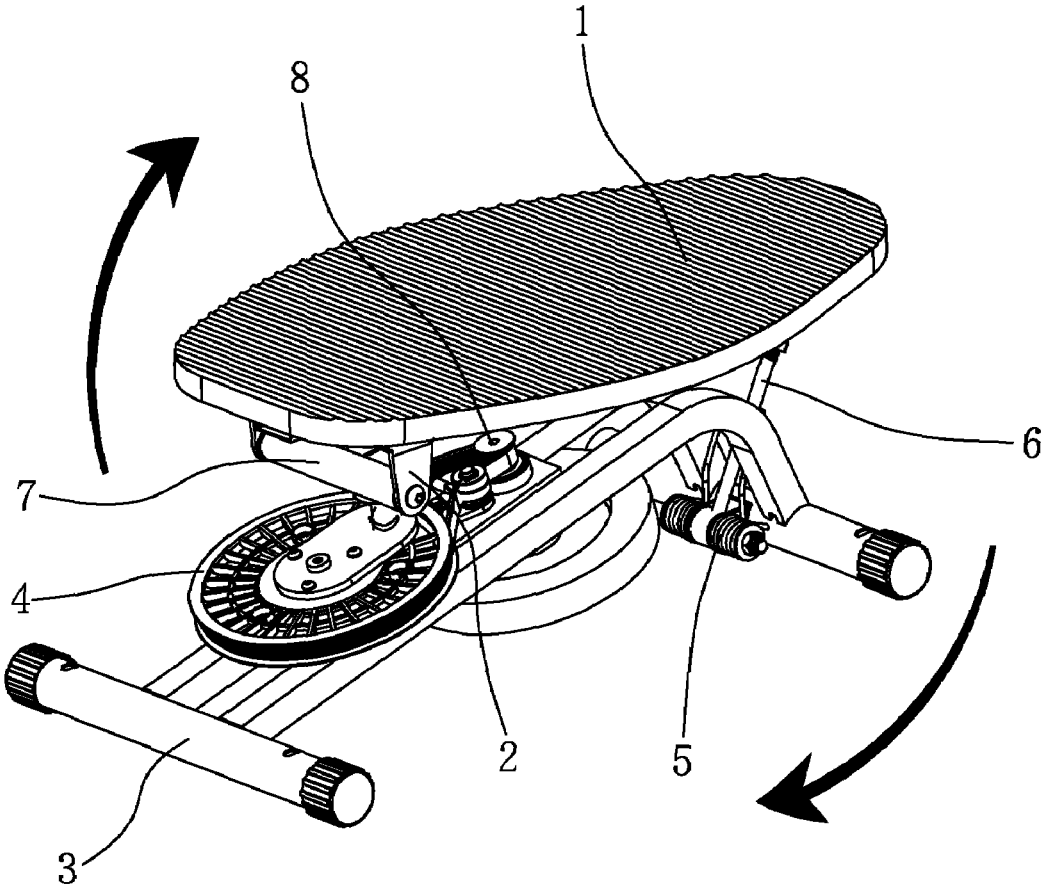
FIG. 3 is a perspective view of a second preferred embodiment of the present invention.

As shown in FIGS. 2 and 3, a surfing exerciser of a first preferred embodiment of the present invention comprises a seat 1, a seat frame 2, a chassis 3, a swing device 4, a torsion spring 5, a rocker 6, a transition rack 7, a belt tension adjusting mechanism 8, a handle rod 9, and a casing 10. The seat 1 is secured on the seat frame 2. The handle rod 9 has a lower end connected to a front end of the chassis 3.

The swing device 4 comprises an upper flywheel 41, a lower flywheel 42, a Z-shaped swivel shaft 43, a small pulley shaft 44, and a belt 45. The Z-shaped swivel shaft 43 comprises a lower swivel shaft 431, an upper swivel shaft 432, and a connecting board 433. The lower swivel shaft 431 is fixed to a lower surface of the connecting board 433, and the upper swivel shaft 432 is fixed to an upper surface of the connecting board 433. The axis of the lower swivel shaft 431 obliquely intersects with the axis of the upper swivel shaft 432. The upper flywheel 41 is disposed above the chassis 3, and rotatably fitted on the chassis 3 through the lower swivel shaft 431 of the Z-shaped swivel shaft 43. A first end of the seat frame 2 is rotatably fitted on the upper swivel shaft 432 of the Z-shaped swivel shaft 43 through the transition rack 7. A second end of the seat frame 2 is articulated with an upper end of the rocker 6 through a hinge head 62 and a shaft member 63. A lower end of the rocker 6 is articulated to the chassis 3 through a rocker shaft 61. The small pulley shaft 44 has a wheel driving portion 441 located above the chassis 3 and an axle portion 442 passing through the chassis 3. The lower flywheel 42 has a central hole for insertion of the axle portion 442 of the small pulley shaft 44. The belt 45 is disposed between the upper flywheel 41 and the wheel driving portion 441 of the small pulley shaft 44.

The chassis 3 has a front portion connected with the rocker shaft 61. The lower end of the rocker 6 and the torsion spring 5 are inserted on the rocker shaft 61. The torsion spring 5 has a first end secured to the front end of the chassis 3 and a second end holding against the rocker 6 so that the rocker 6 is able to swing upward for the seat 1 at a high position constantly when in a static state.

The belt tension adjusting mechanism 8 comprises a press block 81, a swing rod 82, a pull rod 83, and a baffle plate 84. The press block 81 is located at an outer side of the belt 45 and holds against the belt 45. The swing rod 82 has a first end connected to a lower end of the press block 81 and a second end inserted on a pin 85 which is fixed on the chassis 3. The pull rod 83 has a first end connected to the press block 81 and a second end passing through the baffle plate 84 and screwed with a nut for adjusting the length of the pull rod by rotating the nut.

The casing 10 is adapted to accommodate the swing device 4 therein, preventing the user from hitting the swing device 4.

The seat 1 of the present invention is rotatably mounted on the upper swivel shaft 432 of the Z-shaped swivel shaft 43, and the lower swivel shaft 431 of the Z-shaped swivel shaft 43 is rotatably fitted on chassis 3. When an external force acts on the seat 1, the Z-shaped swivel shaft 43 will produce a tangential force to drive the upper flywheel 41 to rotate because the axes of the lower swivel shaft 432 and upper swivel shaft 432 are intersected obliquely. The upper flywheel 41 brings the lower flywheel 42 to rotate through the belt 45. By the rotation inertia of the upper flywheel 41 and the lower freewheel 42, the seat 1 of the present invention is able to move up and down as well as left and right.

FIG. 3 is a second preferred embodiment of the present invention, which is substantially similar to the first preferred embodiment with the exception that there isn't the handle rod 9.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A surfing exerciser, comprising a seat, a seat frame, a chassis, a swing device, and a torsion spring; the seat being secured on the seat frame, the swing device comprising an upper flywheel, a lower flywheel, a Z-shaped swivel shaft, a small pulley shaft, and a belt; the Z-shaped swivel shaft comprising a lower swivel shaft having an axis, an upper swivel shaft having an axis and a connecting board, the lower swivel shaft being fixed to a lower surface of the connecting board, the upper swivel shaft being fixed to an upper surface of the connecting board, the axis of the lower swivel shaft obliquely intersecting with the axis of the upper swivel shaft, the upper flywheel being disposed above the chassis and rotatably fitted on the chassis through the lower swivel shaft of the Z-shaped swivel shaft; a first end of the seat frame being rotatably fitted on the upper swivel shaft of the Z-shaped swivel shaft through a transition rack, a second end of the seat frame being articulated to the chassis through a rocker; the small pulley shaft having a wheel driving portion located above the chassis and an axle portion passing through the chassis; the lower flywheel having a central hole for insertion of the axle portion of the small pulley shaft, the belt being disposed between the upper flywheel and the wheel driving portion of the small pulley shaft; the torsion spring being coupled to a front portion of the chassis and holding against the rocker for the seat at a high position constantly when in a static state.

2. The surfing exerciser as claimed in claim 1, wherein the front portion of the chassis is inserted with a rocker shaft, a lower end of the rocker and the torsion spring being inserted on the rocker shaft, the torsion spring having a first end secured to a front end of the chassis and a second end holding against the rocker for the rocker to swing upward.

3. The surfing exerciser as claimed in claim 1, further comprising a belt tension adjusting mechanism, the belt tension adjusting mechanism comprising a press block, a swing rod, a pull rod, and a baffle plate; the press block being located at an outer side of the belt and holding against the belt; the swing rod having a first end connected to a lower end of the press block and a second end inserted on a pin fixed on the chassis; the pull rod having a first end connected to the press block and a second end passing through the baffle plate and screwed with a nut for adjusting the length of the pull rod by rotating the nut.

4. The surfing exerciser as claimed in claim 1, further comprising a handle rod, the handle rod having a lower end fixed to a front end of the chassis.

* * * * *